US010433592B2

(12) United States Patent
Olshansky

(10) Patent No.: US 10,433,592 B2
(45) Date of Patent: Oct. 8, 2019

(54) HALF CORSET

(71) Applicant: Yelena Olshansky, Jersey City, NJ (US)

(72) Inventor: Yelena Olshansky, Jersey City, NJ (US)

( * ) Notice: Subject to any disclaimer, the term of this patent is extended or adjusted under 35 U.S.C. 154(b) by 239 days.

(21) Appl. No.: 15/331,418

(22) Filed: Oct. 21, 2016

(65) Prior Publication Data

US 2018/0110264 A1 Apr. 26, 2018

(51) Int. Cl.
*A41C 1/00* (2006.01)
*A41C 1/02* (2006.01)

(52) U.S. Cl.
CPC ..... *A41C 1/003* (2013.01); *A41C 1/02* (2013.01)

(58) Field of Classification Search
CPC ..... A41C 1/006; A41C 1/02
USPC ..... 450/94, 100, 102, 104, 105
See application file for complete search history.

(56) References Cited

U.S. PATENT DOCUMENTS 2,053,165 A * 9/1936 Pruett ..... A41B 9/08 450/104
2,490,137 A * 12/1949 Keller ..... A41C 1/003 2/401
2,682,662 A * 7/1954 Laura ..... A41C 1/06 2/78.2
2,896,633 A * 7/1959 McKee ..... A41C 1/00 450/102
3,035,585 A * 5/1962 Neiman ..... A41C 1/003 450/100
3,314,433 A * 4/1967 Champagne ..... A41C 1/00 450/104
3,503,405 A * 3/1970 Porco ..... A41B 9/007 2/406
3,974,836 A * 8/1976 Carlson ..... A41C 1/003 2/408
5,038,760 A * 8/1991 Osborn ..... A61F 5/028 2/44
5,636,387 A * 6/1997 Lundy ..... A61F 5/0096 2/400
6,000,993 A 12/1999 Erwin
6,234,867 B1 5/2001 Fanelli
7,426,754 B2 9/2008 Chun
7,988,527 B2 8/2011 Christensen
8,108,947 B2 * 2/2012 Beauvais ..... A41B 9/08 128/889
8,747,186 B2 6/2014 Fong
9,149,076 B2 10/2015 Almog
2006/0166600 A1 7/2006 Ravoiu
2006/0276103 A1 12/2006 Teng
2007/0174950 A1 8/2007 Gidish
2014/0350509 A1 11/2014 Bigelow

* cited by examiner

*Primary Examiner* — Megan E Lynch
(74) *Attorney, Agent, or Firm* — DLA Piper LLP, US

(57) ABSTRACT

Provided are half corsets and methods of using them. The half corsets provide improved comfort and a quicker way of fastening and unfastening them. The half corsets have a body garment with four sides, two lateral garments, a flap that connects two of the sides with each other via a couple of fastener patches, and at least two support strips. The half corsets are designed to be worn around an individual's abdomen, pelvic region, and upper thighs.

13 Claims, 4 Drawing Sheets

HALF CORSET

FIELD OF THE INVENTION

The present disclosure relates to clothing, and more specifically to support garments or half corsets that are designed to cover lower half of a torso below the breast while extending to the top of the thighs.

BACKGROUND

Corsets are garments that support at least a portion of the torso of an individual. These garments are often difficult to fasten and unfasten. For example, when trying to unbuckle, unhook, or unbutton a corset at its latch between the legs, a user would have difficulty in seeing the latch, and would further find it awkward and slow to unfasten the latch. This is especially problematic when speed matters most, particularly for women who are elderly or who have various mobility issues.

Additionally, corset users frequently suffer from discomfort due to support strips that irritate the skin near the sides of the user.

Thus, what is needed is a better corset that allows a user to quickly fasten and unfasten it and one that is comfortable to wear.

SUMMARY

It has been discovered that a half corset having a fastener, such as a hook and loop fastener, located on or near the abdomen—not having its fastening (e.g., clasping) point between the legs—provides for a quicker fastening and unfastening. It has been further discovered that a half corset having support strips at locations other than the left and right sides of a user provides support while being more comfortable to wear.

For example, the half corset disclosed here can have a Velcro fastener, not between the legs but at an area lower than the center of the abdomen allows the user to fasten and unfasten the half corset with ease. In addition, avoiding support strips on the user's left and right sides, and instead placing them on other locations (e.g., four plastic ones in the front and four plastic ones in the rear) increases comfort and prevents irritation to a user's armpits. The flap can be long or extra-long, which both allows adjustments to the way it is fastened and allows a sanitary article to be placed into the half corset. One may use the half corset with or without the sanitary article. The half corset can be constructed to be light-weight and form-fitting. It can be made from elastic (e.g., stretchable) materials such as spandex, or breathable materials such as cotton. It can also have some parts elastic (e.g., body garment), while having other parts breathable (e.g., flap). The half corset can be operated discreetly and in a hassle-free way. The half corset can have a stitched seam on its sides to improve comfort and mobility. It can also have a longer garment below the body garment (e.g., between the waist and the flap), either as a fitting preference for comfort, for visibility concerns, or in order to accommodate garter clips. Garter clips, in some embodiments, would allow a user to attach stockings to the half corset.

Accordingly, an aspect of the invention provides for a half corset for covering portions of an individual's abdomen, pelvic region, and thighs. The half corset includes a body garment, a first lateral garment, a second lateral garment, a flap, and at least two support strips. In one embodiment, the body garment has a median length, an inner surface, an outer surface, a first opening, and a second opening opposite to the first opening. In other embodiments, the body garment further has a first side; a second side adjacent to the first side; a third side opposite to the first side along an odd transverse axis, the third side further being adjacent to the second side; a fourth side opposite to the second side along an even transverse axis, the fourth side further being adjacent to both the first side and the third side; and a first fastener patch near the first opening, the first fastener patch being on the third side and on the outer surface. In one embodiment, the first lateral garment of the half corset extends from the body garment near the first opening and the second side. The second lateral garment can extend from the body garment near the first opening and the fourth side, the second lateral garment being opposite to the first lateral garment. The flap can extend from the body garment near the first opening and the first side, the flap being between the first lateral garment and the second lateral garment, and the flap having a terminal end distal from the second opening. In other embodiments, the flap further has a second fastener patch near the terminal end, the second fastener patch being attachable to the first fastener patch when the flap is flexibly curved between the first lateral garment and the second lateral garment toward the first fastener patch. In some embodiments, the support strips can extend in directions between the first opening and the second opening away from portions of the second side and the fourth side that are along the even transverse axis.

In another embodiment, the third side of the half corset has a higher median length than both the second side and the fourth side. In some embodiments, the first fastener patch and the second fastener patch form pairs of a hook and loop fastener. In one embodiment, the flap can further have an area for receiving a sanitary article.

In some embodiments, the half corset has eight support strips extending in directions between the first opening and the second opening, two of the support strips being located on the first side, two of the support strips being located on the third side, one of the support strips being located near a boundary between the first side and the second side, one of the support strips being located near a boundary between the second side and the third side, one of the support strips being located near a boundary between the third side and the fourth side, and one of the support strips being located near a boundary between the fourth side and the first side.

In certain embodiments, the second side and the fourth side curve toward the outer surface near the first opening and the second opening. In some embodiments, the body garment is made from an elastic material. The first lateral garment and the second lateral garment can also be made from an elastic material. The flap may as well be made from an elastic material. In some embodiments, the flap can be made from a breathable material, such as cotton.

In another embodiment, the half corset further includes a third lateral garment that completes a portion of the first lateral garment into a first tubular segment. In some embodiments, the half corset further includes a fourth lateral garment that completes a portion of the second lateral garment into a second tubular segment. The half corset can be substantially made from a material that comprises spandex. The half corset can also be substantially made from a material that comprises cotton. In an embodiment, the half corset further has a longitudinal fastener along one of its sides that allows opening the body garment. The longitudinal fastener can be a zip fastener. The half corset can be made from multiple materials as well. For example, it can have a body garment made from stretchable material and a flap made from breathable material.

In another aspect, the present invention provides, in part, for a shapewear for wearing around an individual's areas running from lower torso to upper thighs. Such a shapewear includes a front side, the front side having a first member of a hook and loop fastener; a rear side opposite to the front side; a left side connecting the front side to the rear side; a right side connecting the front side to the rear side, the right side being opposite from the left side; an upper portion having an upper opening; a lower portion having a lower opening; and a flap connected to the rear side, the flap having a second member of a hook and loop fastener, the second member being attachable to the first member, thereby allowing attaching the flap to the front side.

In one embodiment, the shapewear further includes at least two support splines that run from the upper half portion to the lower half portion. In some embodiments, the shapewear has four support splines distributed non-collinearly with central longitudinal axes of the left side and the right side. In other embodiments, the shapewear includes eight support splines distributed away from the central longitudinal axes of the left side and the right side. In some embodiments, the shapewear can be made at least partially from an elastic garment.

The embodiments described above have various advantages. For example, the location of the fastener away from between the legs allows a user to quickly fasten and unfasten the half corset. In addition, the locations of the support strips remove or at least reduce the discomfort associated with support strips that irritate the sides of a user. Moreover, in some embodiments, longer leg openings that are closer in length to a men's brief and the employed stitched stretchy material used to create a fitted support especially near the sides provide for added shape and accentuated body shape.

DESCRIPTION

The disclosures of any patents, patent applications, and publications referred to herein are hereby incorporated by reference in their entireties into this application in order to more fully describe the state of the art as known to those skilled therein as of the date of the invention described and claimed herein. The instant disclosure will govern in the instance that there is any inconsistency between the patents, patent applications, and publications and this disclosure.

Unless defined otherwise, all technical and scientific terms used herein have the same meaning as commonly understood by one of ordinary skill in the art to which this disclosure belongs. The initial definition provided for a group or term herein applies to that group or term throughout the present specification individually or as part of another group, unless otherwise indicated.

The present disclosure provides a half corset designed to cover an area below the breasts. More specifically, the half corset is designed to cover an area starting from the lower torso (e.g., the abdomen) and extending to the pelvic region. The half corset may further extend to the upper thigh area. For example, in an embodiment, the half corset surrounds an individual's body around the abdomen as well as around the upper thigh area. The half corset may cover the upper thigh area in a way that is similar to how a men's brief does.

The half corset solves several problems that the currently available models present. For instance, the current models are difficult to operate when a user needs to use a restroom, because the currently available models tend to have hook latches between the legs. Although such a location may be appealing due to its discreet nature, for the same reason, it is difficult to see for the one wearing the corset or half corset. Concomitantly, users often find it awkward and cumbersome to operate (e.g., button/unbutton, hook/unhook, latch/unlatch, fasten/unfasten, close/open) the corset or half corset. Another problem concerns the discomfort associated with solid support pieces, which often irritate the left and right sides of a user.

Figure 1:
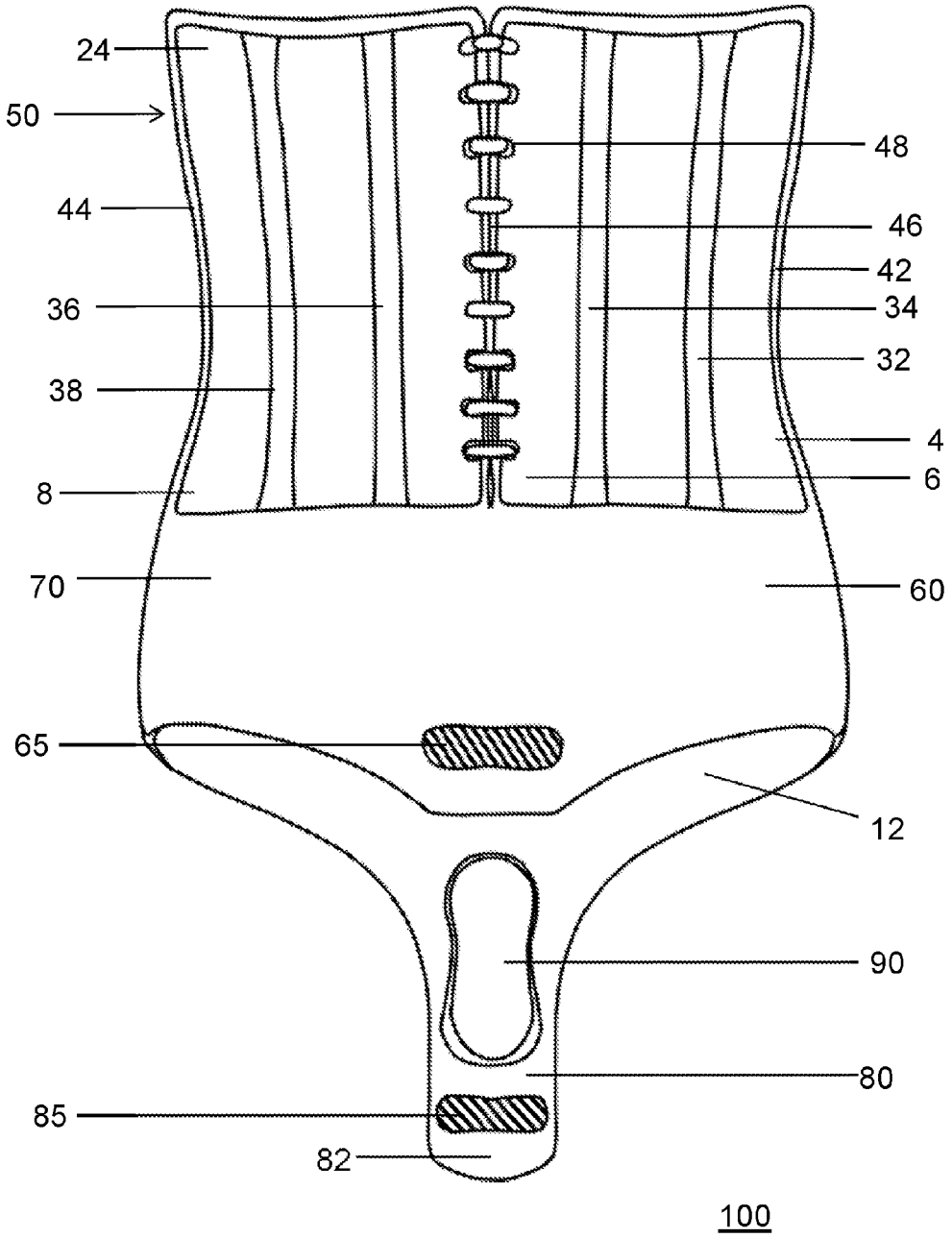
FIG. 1: A schematic showing an embodiment of a half corset from the front side of a user.

As shown in FIG. 1, half corset 100 includes body garment 50 that surrounds at least a portion (e.g., all) of a user's abdomen. The body garment may also cover a portion of a user's pelvic region. The body garment can be made from a variety of materials, including flexible ones as well as elastic ones. For example, the body garment can be made from, in part or in full, spandex or cotton.

Body garment 50 has four sides: first side 2 (not shown in FIG. 1; shown in FIG. 2, and as a similar first side 2B for a different embodiment in FIG. 3), second side 4, third side 6, and fourth side 8. In one embodiment, a user would wear the half corset so that the first side is on her rear, the second side is on her left, the third side is on her front, and the fourth side is on her right.

Figure 3:
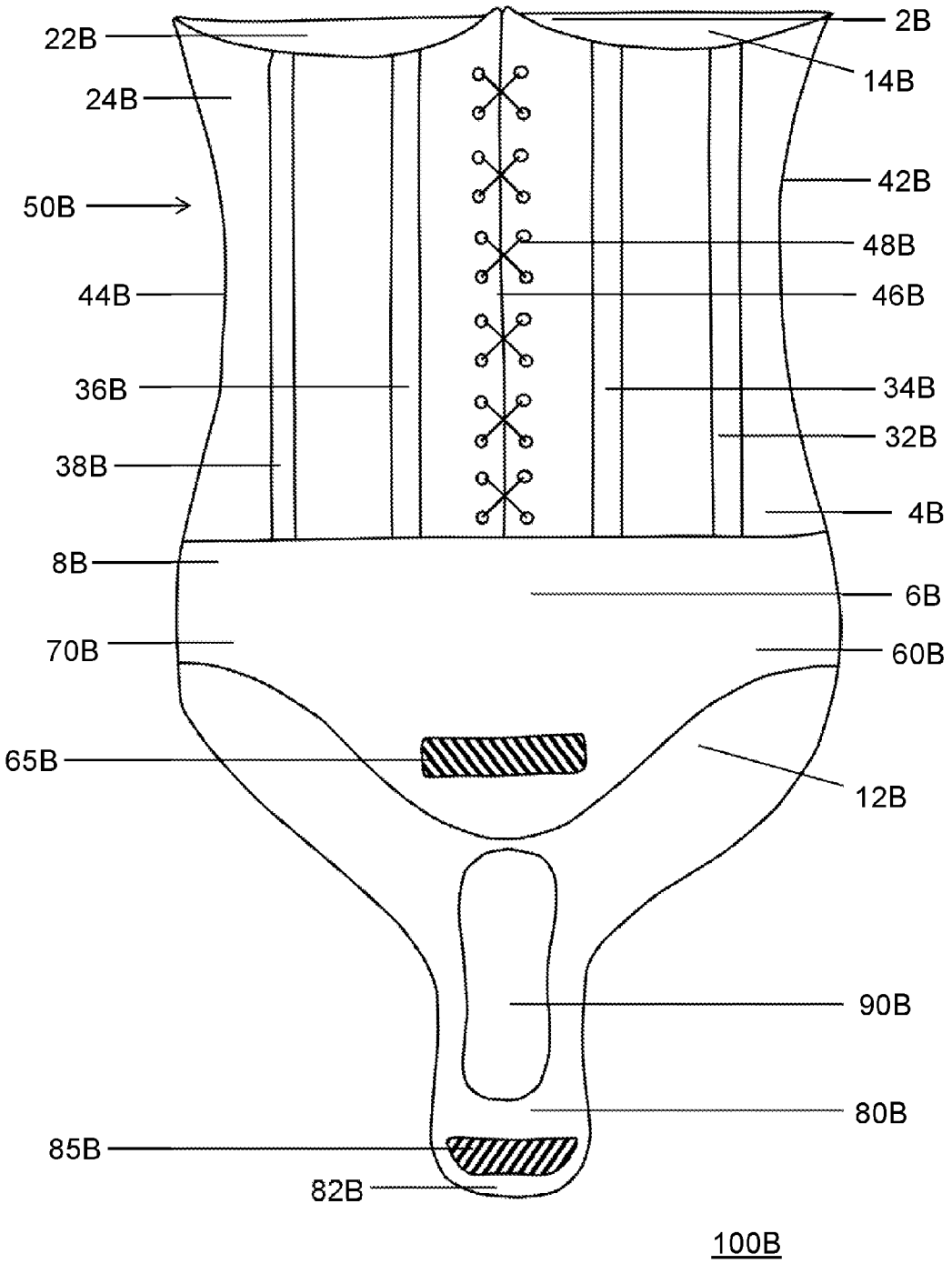
FIG. 3: A schematic showing another embodiment of a half corset from the front side of a user.

Body garment 50 additionally has first opening 12 and second opening 14 (not shown in FIG. 1; a similar part, second opening 14B shown in FIG. 3). In an embodiment, a user would wear the half corset so that the first opening faces toward her feet and the second opening faces toward her head.

In some embodiments, as shown in the FIG. 1, second side 4 and fourth side 8 are curved outward, via second side curve 42 and fourth side curve 44, respectively, near first opening 12 and second opening 14. This can be accomplished by either designing the second and fourth sides to be wider near these openings, or in general designing the full body garment so that it has longer circumferences near the two openings. All of these designs are encompassed within the description of the second side and the fourth side curving toward the outer surface near the first opening and the second opening.

Overall, body garment 50 has a median length, inner surface 22 (not shown in FIG. 1; a similar part, inner surface 22B shown in FIG. 3), and outer surface 24. In an embodiment, a user wears the half corset so that the inner surface is closer to the user's body than is the outer surface. The median length of the body garment is simply the arithmetic median of the various lengths of the four sides. In an embodiment, the median length can be found by measuring lengths of 1 cm strips of the body garment, each strip being perpendicular to the general direction of circumferences (e.g., the central circumference), and then calculating the median of such lengths. In addition, the present invention defines an odd transverse axis, which is between the central point of (e.g., midway along the length of and also midway along the width of) the first side and the central point of the third side. Similarly, an even transverse axis is defined to be between the central point of (e.g., midway along the length of and also midway along the width of) the second side and the central point of the fourth side.

The term "tubular," as used herein, encompasses typical cylindrical shapes as well as shapes that are like a tube, including those with variable lengths along a circumference and variable circumferences along a length. The body garment, in an embodiment, has a flexible shape, in other words, it can collapse and can be folded into other configurations. In certain embodiment, the body garment also has an elastic shape, in other words, its lengths and circumferences can be changed.

Body garment 50 additionally has first fastener patch 65 near first opening 12 and on third side 6. The first fastener patch may be any fastener that fastens the third side to another part of the half corset. In an embodiment, the first fastener patch is a hook part of a hook and loop fastener (e.g., Velcro®). In another embodiment, the first fastener patch is the loop part of a hook and loop fastener. In other embodiments, both the first fastener patch and the second fastener patch have both hook and loop components of a hook and loop fastener. Either patch may include hooks or loops.

Half corset 100 further has flap 80 that extends from first side 2. Flap 80, in some embodiments, passes through the legs of a user when worn. For example, the flap may hang from the rear side of a user, and the user may pull the flap to attach it to the first fastener patch, thereby passing the flap between her legs. Flap 80, as shown in the FIG. 1, has terminal end 82 and second fastener patch 85. The second fastener patch fastens to the first fastener patch, thereby attaching the flap to the third side. In an embodiment, the second fastener patch is a hook part of a hook and loop fastener (e.g., Velcro®). In another embodiment, the second fastener patch is the loop part of a hook and loop fastener. In other embodiments, both the first fastener patch and the second fastener patch have both hook and loop components of a hook and loop fastener. The flap is designed to be flexible, so that a user can pass it between her legs and attach it to the third side. The term "flexibly curved" is used herein to denote that feature of the flap. The flap can also be elastic. Therefore, the flap may be flexibly curved to pass it between the legs, but the same flexibly curved flap may also be held straight when it is not attached to the third side. In an embodiment, the first fastener patch is on the outer surface of the body garment. In other embodiments, it may also be on the inner surface of the body garment. In an embodiment, the second fastener patch is placed on the terminal end of the flap so that the flap need not be twisted in order for it to be attached to the third side. In alternative embodiments, the second fastener patch may be placed on either surface of the flap.

The term "garment," as used herein, can be made of any material that can be made into clothes, including natural materials as well as synthetic materials. For example, the garment can include leather. Some other non-limiting examples of materials that can be made into the garment include cotton, flax, wool, ramie, silk, other fabrics, denim, down, down-filled materials, fur, faux-fur, nylon, polyesters, spandex, rubber, acetate, cupro, flannel, lyocell, polyvinyl chloride, rayon, Tyvek, bamboo, jute, hemp, and the like. Mixtures of any of these materials, in various percentages, may also be used to construct the garments (e.g., the body garment, any of the lateral garments, and the flap). Any of the materials may be flexible or both flexible and elastic.

Various materials for the garments (e.g., the body garment, any of the lateral garments, the flap) may be obtained from commercial manufacturers. For example, The Fabric Stock Exchange (Peekskill, N.Y.), Metro Textile Corporation (Richardson, Tex.), or World Class Textiles (Los Angeles, Calif.). Specifically, elastic materials such as spandex may be obtained from Milliken & Company (Spartanburg, S.C.), Spandex House (New York, N.Y.), or Top Value Fabrics (Carson, Calif.).

The term "side," as used herein, refers to one of the segments of the body garment when the body garment is divided into four segments via boundaries that run between the first opening and the second opening. Each side has an inner surface and an outer surface.

Half corset 100, as shown in the FIG. 1, further includes two lateral garments: first lateral garment 60 and second lateral garment 70. The first lateral garment extends from the second side near the first opening, while the second lateral garment extends from the fourth side near the first opening. In an embodiment, the first lateral garment encloses portions of a user's left thigh, while the second lateral garment encloses portions of a user's right thigh. Because they both cover the sides, these garments by themselves only enclose, in these embodiments, less than full circumferences of a user's thighs. In alternative embodiments, the half corset further includes a third lateral garment that completes a part of the first lateral garment to a first tubular segment, which may fully enclose a portion of a user's thigh (e.g., left thigh). In some embodiments, similarly, the half corset further includes a fourth lateral garment that completes a part of the second lateral garment to a second tubular segment, which may fully enclose a portion of a user's thigh (e.g., right thigh). Therefore, as used herein, the term "lateral garment" denotes a garment with a shape that has circumferences that are less than those of a full cylindrical shape (e.g., part of a cylindrical shape that is cut by a plane in a direction perpendicular to its circumferences into two parts).

The term "opposite," as used herein, refers to sides or lateral garments being distal to each other as opposed to being adjacent to each other. In some embodiments, when a user wears the half corset, the two lateral garments may be opposite from each other, for example while they are separated from each other by the flap between them.

The term "terminal end," denotes the last portion of the flap (e.g., flap) that is furthest away from the portion of the flap that extends from the first side. For the sake of this definition, the flap is contemplated to be stretched out away from the body garment, since otherwise the meanings of "distal" or "furthest away" would be ambiguous due to the flexible nature of the flap. The terminal end of the flap is where the second fastener patch is in some embodiments. In alternative embodiments, the fastener patch may be at a location between the terminal end and the portion of the flap that is closest to the first opening.

Turning back to FIG. 1, half corset 100 also includes at least two support strips. It may also include four support strips: first support strip 32, second support strip 34, third support strip 36, and fourth support strip 38. In various embodiments, the number of support strips (e.g., support splines) can be changed. For example, the half corset may have 2, 3, 4, 5, 6, 7, 8, 9, 10, 11, 12, 13, 14, 15, or 16 support strips. In an embodiment, the half corset has eight support strips: distributed with distances along the circumferences that are roughly similar to each other, while keeping the medial length axis of the second side and fourth side free from any support strips. Therefore, in an embodiment, the user would have no support strips that are exactly on the left side or the right side, but would have other support strips that are away from the anatomical lateral sides of the user. The embodiment shown in FIG. 1 (front view) and FIG. 2 (rear view) has eight support strips: first support strip 32, second support strip 34, third support strip 36, fourth support strip 38, fifth support strip 33, sixth support strip 35, seventh support strip 37, and eighth support strip 39.

As shown in FIG. 1, flap 80 may further have a space that accommodates sanitary article 90. The term "sanitary article," as used herein, denotes any hygiene product that a user may desire to place into this area. An example of such a sanitary article is a sanitary napkin.

As further shown in FIG. 1, body garment 50 includes longitudinal fastener 46 on third side 6. In this embodiment, longitudinal fastener has longitudinal fastener elements 48, which may be buttons. In an embodiment, the longitudinal fastener is a zip fastener. In another embodiment, the longitudinal fastener comprises laces or hooks.

Figure 2:
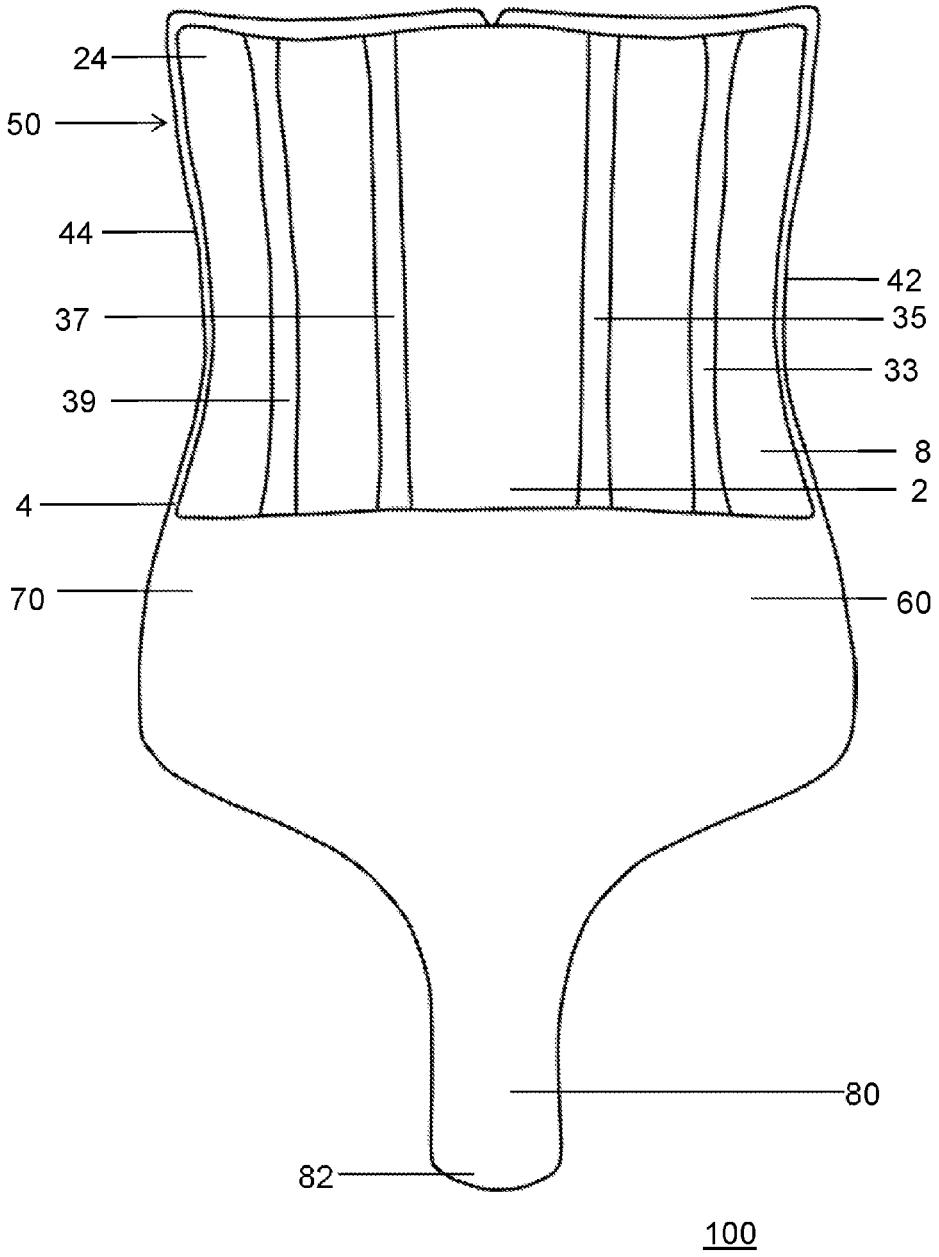
FIG. 2: A schematic showing an embodiment of a half corset from the rear side of a user.

FIG. 2 shows the same embodiment as shown in FIG. 1. The view in FIG. 2 is in the direction from first side 2 toward third side 6 (not shown in FIG. 2; shown in FIG. 1). In an embodiment, the first side is the rear side and the third side is the front side of the body garment. FIG. 2 shows four support strips (parts 33, 35, 37, and 39), in addition to showing other parts that have been described with respect to FIG. 1.

FIG. 3 depicts another embodiment of the half corset. In a similar fashion to half corset 100 of FIG. 1, half corset 100B is shown in FIG. 3 having the following parts: first side 2B, second side 4B, third side 6B, fourth side 8B, first opening 12B, second opening 14B, inner surface 22B, outer surface 24B, first support strip 32B, second support strip 34B, third support strip 36B, fourth support strip 38B, second side curve 42B, fourth side curve 44B, longitudinal fastener 46B, longitudinal fastener element 48B, body garment 50B, first lateral garment 60B, second lateral garment 70B, first fastener patch 65B, second fastener patch 85B, flap 80B, terminal end 82B, and sanitary article 90B. Garter clips can be used to hold long socks or stockings. The garter clips can be of loop-and-button or suspender type. Any other types of garter clips can be used as well as long as attach to long socks.

Figure 4:
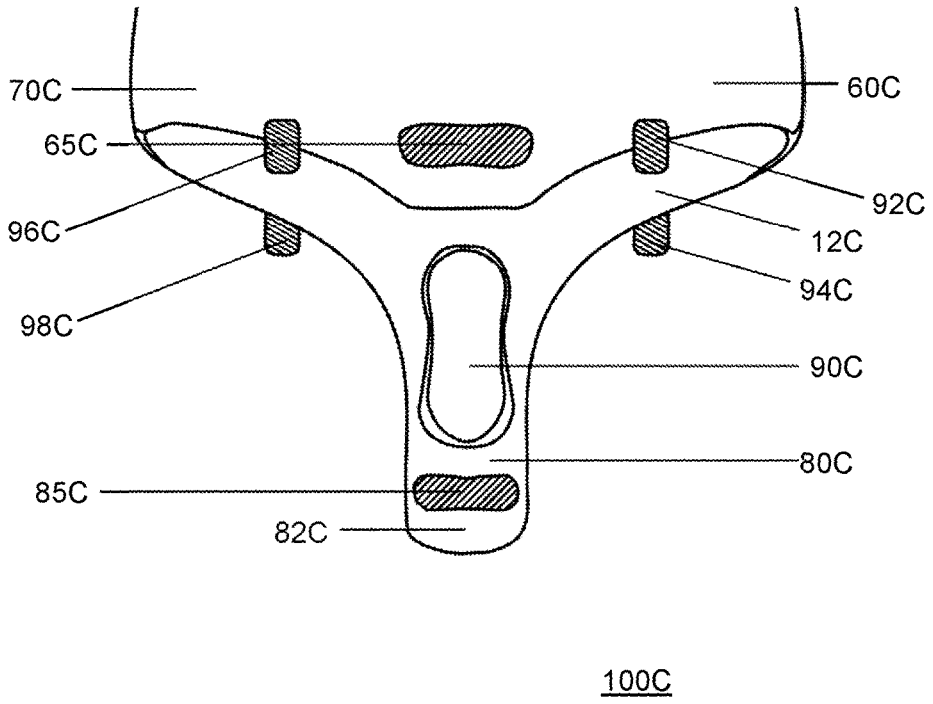
FIG. 4: A schematic showing a portion of a yet another embodiment of a half corset from the front side of a user.

FIG. 4 shows another embodiment of the half corset. Depicted is half corset 100C, which has garter clips. As seen, the half corset has first garter clip 92C, second garter clip 94C, third garter clip 96C, and fourth garter clip 98C. Also shown in FIG. 4 are the following parts: first opening 12C, first lateral garment 60C, second lateral garment 70C, first fastener patch 65C, second fastener patch 85C, flap 80C, terminal end 82C, and sanitary article 90C.

The term "non-collinearly," as used herein, describes the condition of two linear objects, such as an axis and a support strip not being aligned along a shared line. For example, two lines (e.g., a support strip and an axis) would be non-collinear if they are side by side or away from each other in any other way. In some embodiments, the support strips are each non-collinear with the central longitudinal axes (i.e., the axis on a side that runs between the first opening and the second opening while tracing the mid-points of the portions of the circumferences that belong to the respective side) of the second side and the fourth side. Similarly, the term "away from," as used herein, denotes the condition of the support strips (e.g., support splines) not being collinear with or closer than 2 cm to the central longitudinal axes of the reference sides. In an embodiment, the support sides are all away from the anatomical lateral side edges of an individual wearing the half corset.

The disclosure also provides methods of using the disclosed half corsets. In an embodiment, a user unfastens the flap from the third face by pulling the flap away from the third side, thereby opening the first opening. In another embodiment, a user fastens the flap to the third face by pressing the first fastener patch against the second fastener patch, thereby closing the opening. In another embodiment, a user places a sanitary article into an area on the flap before fastening the flap.

EQUIVALENTS

Those skilled in the art will recognize, or be able to ascertain, using no more than routine experimentation, numerous equivalents to the specific embodiments described specifically herein. Such equivalents are intended to be encompassed in the scope of the following claims.

What is claimed is:

1. A half corset for covering below-the-breasts portions of an individual's abdomen, pelvic region, and thighs, the half corset comprising:

a body garment, the body garment having a median length, an inner surface, an outer surface, a first opening, and a second opening opposite to the first opening, the body garment further having:

a first side;

a second side adjacent to the first side;

a third side opposite to the first side, the third side further being adjacent to the second side, the third side having a longer length than both the second side and a fourth side;

the fourth side opposite to the second side, the fourth side further being adjacent to both the first side and the third side; and a first fastener patch near the first opening, the first fastener patch being on the third side and on the outer surface;

a flap extending from the body garment near the first opening and the first side, the flap being flexibly curvable toward the third side so as to reach a portion of the third side between the second side and the fourth side, the flap having a terminal end distal from the second opening, the flap further having:

a second fastener patch near the terminal end, the second fastener patch being attachable to the first fastener patch when the flap is flexibly curved toward the first fastener patch, so that the half corset is fastened and unfastened on the abdomen below the abdomen's center and above a crotch location between upper thighs of the individual; and an area, disposed away from the second fastener patch, for receiving a sanitary article, wherein the flap has a substantially uniform width between the terminal end and the area; and at least two support strips extending in directions between the first opening and the second opening.

2. The half corset of claim 1, the first fastener patch and the second fastener patch forming pairs of a hook and loop fastener.

3. The half corset of claim 1, having eight support strips extending in directions between the first opening and the second opening:

two of the support strips being located on the first side;

two of the support strips being located on the third side;

one of the support strips being located near a boundary between the first side and the second side;

one of the support strips being located near a boundary between the second side and the third side;

one of the support strips being located near a boundary between the third side and the fourth side; and one of the support strips being located near a boundary between the fourth side and the first side.

4. The half corset of claim 1, the body garment comprising an elastic material.

5. The half corset of claim 1, the flap comprising a breathable material.

6. The half corset of claim 1, the half corset comprising a material that comprises spandex.

7. The half corset of claim 1, the half corset comprising a material that comprises cotton.

8. The half corset of claim 1, the half corset further having a longitudinal fastener along one of its sides that allows opening the body garment.

9. The half corset of claim 8, wherein the longitudinal fastener is a zip fastener.

10. A shapewear for wearing around an individual's areas running from the lower torso below the breasts to upper thighs, the shapewear comprising:

a front side, the front side having a first member of a hook and loop fastener on an outer surface of the shapewear, the first member being positioned to be on the individual's abdomen below the abdomen's center and above a crotch location between the individual's upper thighs when worn;

a rear side opposite to the front side;

a left side connecting the front side to the rear side;

a right side connecting the front side to the rear side, the right side being opposite from the left side;

an upper portion having an upper opening;

a lower portion having a lower opening; and a flap connected to the rear side, the flap having a terminal region having a substantially uniform width, the flap having a second member of a hook and loop fastener at the terminal region, the flap being flexibly curvable to reach a portion of the front side between the left side and the right side, the flap further having an area away from the second member for receiving a sanitary article, the second member being attachable to the first member, thereby allowing attaching the flap to the front side on the abdomen below the abdomen's center and above a crotch location between upper thighs of the individual when worn.

11. The shapewear of claim 10, further comprising at least two support splines that run from the upper half portion to the lower half portion.

12. The shapewear of claim 10, comprising eight support splines distributed away from the central longitudinal axes of the left side and the right side.

13. The shapewear of claim 10, the shapewear comprising an elastic garment.

* * * * *